US006894685B2

(12) United States Patent
Ogusu et al.

(10) Patent No.: US 6,894,685 B2
(45) Date of Patent: May 17, 2005

(54) DRIVING METHOD FOR LUMINOUS ELEMENTS

(75) Inventors: Koji Ogusu, Kariya (JP); Tomohiro Kuno, Nagoya (JP); Takashi Hanaki, Kariya (JP)

(73) Assignee: Denso Corporation, Kariya (JP)

( * ) Notice: Subject to any disclaimer, the term of this patent is extended or adjusted under 35 U.S.C. 154(b) by 262 days.

(21) Appl. No.: 09/939,756

(22) Filed: Aug. 28, 2001

(65) Prior Publication Data

US 2002/0033782 A1 Mar. 21, 2002

(30) Foreign Application Priority Data

Sep. 18, 2000 (JP) ..... 2000-281657
May 25, 2001 (JP) ..... 2001-157630

(51) Int. Cl.[7] ..... G09G 3/10

(52) U.S. Cl. ..... 345/214; 345/55; 345/90; 345/96; 345/204; 345/205; 315/169.1; 315/169.3

(58) Field of Search ..... 345/55, 90, 96, 345/204, 205, 214, 48, 76, 77, 82, 84, 87, 209, 210, 95; 314/169.1, 169.3

(56) References Cited

U.S. PATENT DOCUMENTS 4,652,872 A * 3/1987 Fujita ..... 345/78
4,907,859 A * 3/1990 Takada et al. ..... 349/161
5,404,031 A * 4/1995 Sasaki et al. ..... 257/95
5,844,368 A * 12/1998 Okuda et al. ..... 315/169.3
6,002,206 A * 12/1999 Harrison et al. ..... 313/506
6,191,779 B1 * 2/2001 Taguchi et al. ..... 345/204
6,201,520 B1 3/2001 Iketsu et al.
6,201,522 B1 * 3/2001 Erhart et al. ..... 345/96
6,229,267 B1 * 5/2001 Ushigusa et al. ..... 315/169.4
6,239,777 B1 * 5/2001 Sugahara et al. ..... 345/85
6,351,255 B1 * 2/2002 Ishizuka et al. ..... 345/77
6,380,689 B1 * 4/2002 Okuda ..... 315/169.3
6,501,226 B2 * 12/2002 Lai et al. ..... 315/169.1

FOREIGN PATENT DOCUMENTS

JP A-9-232073 9/1997

* cited by examiner

*Primary Examiner*—Bipin Shalwala
*Assistant Examiner*—Vincent E. Kovalick
(74) *Attorney, Agent, or Firm*—Posz & Bethards, PLC

(57) ABSTRACT

A driving method for driving luminous elements has a luminous element provided at each intersection of anode lines and cathode lines arranged in a matrix. The anode lines are one of scan lines and drive lines and the cathode lines are one of other of scan lines and drive lines. The luminous element provided at an intersection of a desired drive line is driven to emit light in synchronism with scanning while scanning the scan lines at a specific frequency. When switching the scanning line, at least one of the scanning lines is first connected to a first voltage, and the remaining scanning lines are connected at the same time to a second voltage that is different from the first voltage.

12 Claims, 15 Drawing Sheets

DRIVING METHOD FOR LUMINOUS ELEMENTS

CROSS REFERENCE TO RELATED APPLICATION

This application is based on and incorporates herein by reference Japanese Patent Applications No. 2000-281657 filed Sep. 18, 2000 and No. 2001-157630 filed May 25, 2001.

BACKGROUND OF THE INVENTION

The present invention relates generally to a driving method for driving luminous elements to emit light, and more particularly to a driving method for driving current injection type luminous elements having a capacitance component, such as an organic electroluminescent device (EL).

A conventional organic EL driving method is disclosed in U.S. Pat. No. 5,844,368 (JP-A-9-232074). This driving system, which is shown in FIG. 10, is a matrix driving method in which anode lines A1 through Am and cathode lines B1 through Bn are disposed in a matrix (grid). One of the anode lines and cathode lines is sequentially selected and scanned at a fixed time interval, and another line is driven by a drive source, that is, current line 11 through 1*m*, in synchronism with this scan line to cause a luminous element at a desired intersection of anode and cathode lines to emit light.

Scanning switches 21 through 2*n* for selecting either the supply voltage (VCC) or ground potential (O V) are connected to the cathode lines B1 through Bn for sequentially scanning the cathode lines. The ground potential (0V) is sequentially applied to the cathode lines B1 through Bn by scanning while switching switches 21 through 2*n* sequentially to the ground terminal side at fixed time intervals. Drive switches 31 through 3*m* for selecting the current source 11 through 1*m*, that is, the drive source, or the ground potential (0V), are connected to anode lines A1 through Am. Drive current is supplied to a luminous element at a desired anode-cathode intersection by connecting current source 11 through 1*m* to anode line A1 through Am by switching the drive switches 31 through 3*m* on and off in synchronism with the scanning switches.

Driving the luminous elements E1.2 and E1.3 to emit light is described by way of example below. When scanning switch 21 is switched to the ground side and a ground potential is applied to a first cathode line B1 as shown in FIG. 10, luminous elements E1.2 and E1.3 can be made to emit light by switching drive switches 32 and 33 to the current source side and connecting current sources 12 and 13 to anode lines A2 and A3. The luminous elements are controlled so that the luminous element at an arbitrary position emits light and so that the luminous elements appear to emit light concurrently by quickly repeating such scan and drive.

In addition, the reverse bias voltage VCC, which is equal to the source voltage potential, is applied to each of the cathode lines B2 through Bn. The reverse bias voltage VCC is not applied to the cathode line B1 being scanned in order to prevent erroneous emission.

Each of the luminous elements E1.1 through En.m connected at each intersection may be represented by a luminous element E having a diode characteristic and a parasitic capacitor C connected in parallel, as shown by the equivalent circuit in FIG. 11. However, this driving method has the following problems due to the parasitic capacitor C within the equivalent circuit.

FIGS. 12A and 12B show each of the luminous elements E1,1 through En,1 using only the parasitic capacitors C by excerpting the part of the luminous elements E1.1 through En.1 connected to the anode line A1 in FIG. 10. FIGS. 12C and 12D show each of the luminous elements E1.2 through En.2 using only the parasitic capacitors C by excerpting the part of the luminous elements E1.2 through En.2 connected to the anode line A2 in FIG. 10.

When the cathode line B1 is scanned and the anode line A1 is not driven, parasitic capacitor C1.1 of the luminous element E1.1 connected to the cathode line B1 currently being scanned is not charged. However, other parasitic capacitors C2.1 through Cn.1 of luminous elements E2.1 through En.1 are charged in a direction shown in FIG. 12A.

It is assumed that the scanning position is shifted from the cathode line B1 to the next cathode line B2 and the anode lines A1 and A2 are driven in order to cause the luminous elements E2.1 and E2.2 to emit light. The state of the circuit when anode line A1 is driven to drive luminous element E2.1 to emit light is shown in FIG. 12B, and the state of the circuit when anode line A2 is driven to cause luminous element E2.2 to emit light is shown in FIG. 12D.

When luminous element E2.1 is driven to emit light, not only is the parasitic capacitor C2.1 of the luminous element E2.1 charged, but the parasitic capacitors C3.1 through Cn.1 of the luminous elements E3.1 through En.1 connected to the other cathode lines B3 through Bn also are charged because currents flow into the capacitors in the direction as indicated by arrows. On the other hand, when luminous element E2.2 is driven to emit light, only parasitic capacitor C2.2 of luminous element E2.2 is charged as shown in FIG. 12D. It will be noted because the charge causing luminous elements E2.1 and E2.2 to emit light differs greatly, the time needed for the end-to-end voltage of luminous elements E2.1 and E2.2 to reach the level required for the luminous elements to emit light also differs greatly. Accordingly, the brightness of luminous elements E2.1 and E2.2 differs, resulting in uneven luminance.

Another matrix driving method is disclosed in JPA-9-232073. This method, drives organic EL elements to emit light by connecting organic EL elements at the anode line and cathode line intersections of the grid. This method first resets all scanning lines to the same voltage potential when shifting to the next scanning line. This increases the build up speed from applying a voltage to emission.

This method is described next with reference to FIG. 13 through FIG. 15.

In FIG. 13, at first the scanning switch 21 is switched to 0V and the cathode line B1 is scanned. The reverse bias voltage is applied to the other cathode lines B2 through Bn via the scanning switches 22 through 2*n*. Further, the current sources 11 and 12 are connected to the anode lines A1 and A2 via the driving switches 31 and 32. Still further, 0V is applied to the other anode lines A3 through Am via the drive switches 33 through 3*m*.

Accordingly, FIG. 13 illustrates that only the luminous elements E1.1 and E1.2 emit light because only these elements are biased in the forward direction such that driving currents flow into these elements from the current sources 11 and 12, as indicated by arrows in the figure. In the state of FIG. 13, the luminous elements indicated by a hatched capacitor are being charged, respectively, in the direction of the polarity shown in the figure. Then, the reset control shown in FIG. 14 is carried out in shifting the scan so that the luminous elements E2.1 and E2.3 emit light as shown in FIG. 15.

That is, before shifting the scan from the cathode line B1 in FIG. 13 to the cathode line B2 in FIG. 15, all of the driving switches 31 through 3*m* and scanning switches 21 through 2*n* are switched to 0V to shunt all of the anode lines A1 through Am and the cathode lines B1 through Bn to 0V, as shown in FIG. 14, thus discharging any electric charge stored or charged in each luminous element.

After discharging the electric charge stored in all of the luminous elements to zero, only the scanning switch 22, which corresponds to the cathode line B2, is switched to the side of 0V to scan the cathode line B2 as shown in FIG. 15. At the same time, drive switches 31 and 33 shunt the anode lines A1 and A3 to the current sources 11 and 13, and drive switches 32 and 34 through 3*m* are switched to the O V side to apply 0V to the other anode lines A2 and A4 through Am. As a result, only luminous elements E2.1 and E2.3 are biased in the forward direction in the case shown in FIG. 15. Thus, drive current flows from current sources 11 and 13 as shown by arrows so that only luminous elements E2.1 and E2.3 emit light.

Differences in the charge state (FIG. 12A and FIG. 12C) arising from the emission state when cathode line B1 is scanned are cancelled at this time, because the charge stored to all luminous elements is reset to 0V before scanning cathode line B2. As a result, the build-up to emission of luminous elements E2.1 and E2.3 becomes substantially simultaneous. Thus, uneven luminance is solved.

It should be noted here that it is desirable to apply the reverse bias voltage to the luminous elements when driving luminous elements such as organic EL elements in order to increase the service life of these elements. That is, it is desirable in the above method to apply VCC to the cathode line, apply 0V to the anode line, and apply the reverse bias (−VCC) to each luminous element at least once each frame period.

The voltages applied to each luminous element in the above system is shown in FIG. 16. In the state shown in FIG. 16 all luminous elements E1.1, E2.1, E3.1 . . . En.1 on anode line A1 are emitting light (ON), and luminous elements E1.2, E2.2, E3.2 . . . En.2 on anode line A2 are repeatedly emitting light and not emitting light (OFF). The voltages applied to luminous elements E1.1 and E1.2 are shown in FIG. 16. The difference of the voltage of anode line A1 and the voltage of cathode line B1 is applied to luminous element E1.1, and the difference of the voltage of anode line A2 and the voltage of cathode line B1 is applied to luminous element E1.2.

It is understood from the voltage applied to luminous element E1.2 that the reverse bias voltage is applied in the period when luminous element E2.2, for example, is not emitting light.

However, with respect to the voltage applied to luminous element E1.1, there is no period in which the reverse bias is applied because all luminous elements on anode line A1 are emitting light. This is not desirable with respect to luminous element service life.

Furthermore, as shown by the equivalent circuit in FIG. 11, a luminous element such as an organic EL element can be represented as a luminous element E with a diode characteristic and a parallel-connected parasitic capacitor C. The prior art driving method cancels the capacitor effect by discharging the charged capacitance of all luminous elements by connecting all cathode lines to a reset voltage when switching the scanning lines.

With the above driving method, however, the capacitance on the cathode line of the luminous elements to emit light next is also discharged, thus requiring more time to charge the luminous element driven to emit light next, and the build-up speed to emission is thus slow. Fast scanning is therefore not possible.

SUMMARY OF THE INVENTION

It is an object of the present invention to provide an improved driving method for driving luminous elements, which solves uneven luminance problems resulting from differences in the charge states of the luminous elements and at the same time applies the reverse bias to increase service luminous element life.

It is another object of the present invention to provide an improved luminous element driving method, which enables a fast build-up to emission and fast scanning.

According to the present invention, a luminous device has a luminous element provided at each intersection of anode lines and cathode lines arranged in a matrix. The anode lines are one of scan lines and drive lines and the cathode lines are the other of scan lines and drive lines. The luminous element provided at an intersection of a desired drive line is driven to emit light in synchronism with scanning while scanning the scan lines at a specific frequency. When switching the scanning line, at least one of the scanning lines is first connected to a first voltage, and the remaining scanning lines are connected at the same time to a second voltage that is different from the first voltage.

BRIEF DESCRIPTION OF THE DRAWINGS

The above and other objects, features and advantages of the present invention will become more apparent from the following detailed description made with reference to the accompanying drawings. In the drawings.

DESCRIPTION OF THE PREFERRED EMBODIMENTS

Figure 1:
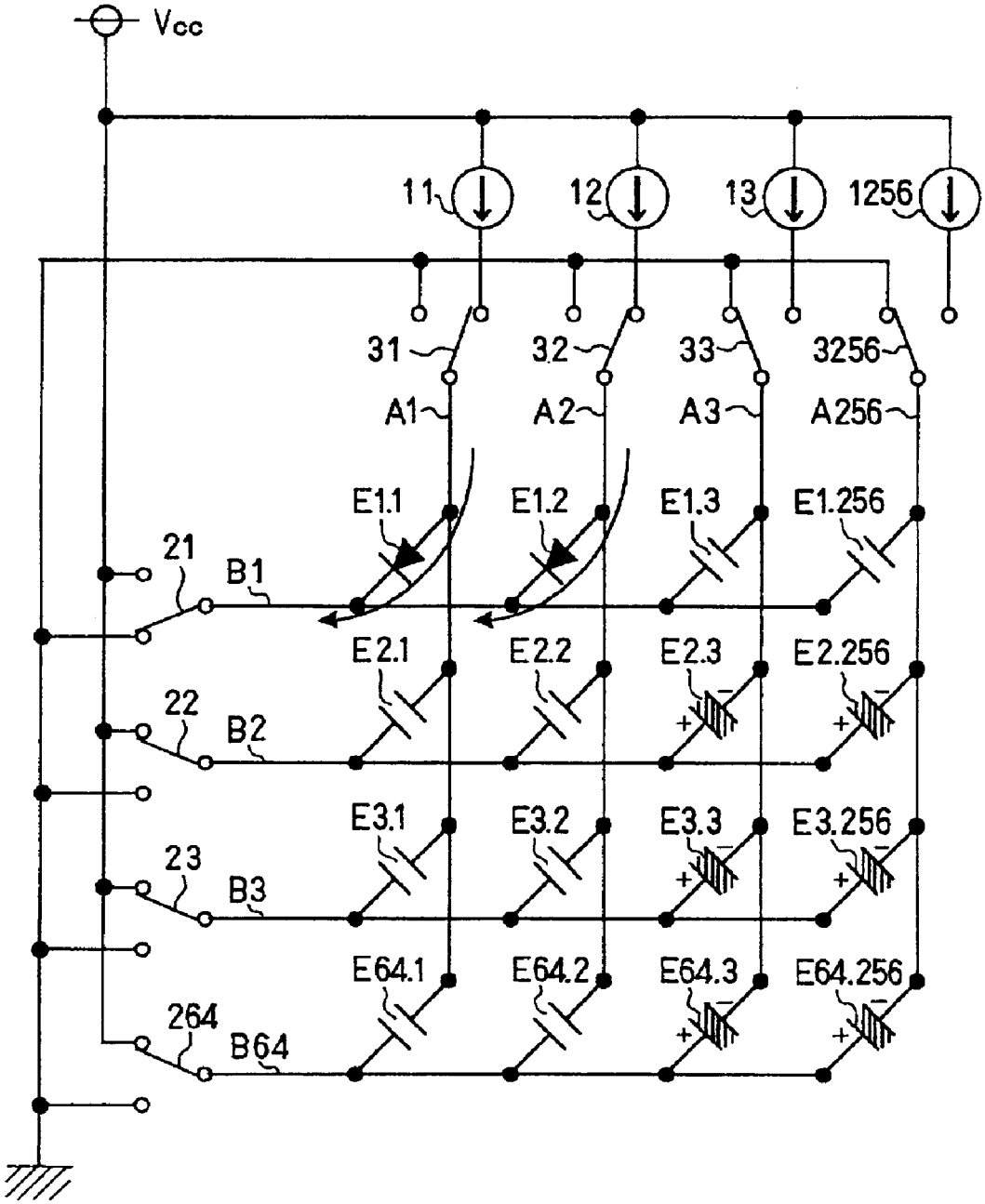
FIG. 1 is an equivalent circuit diagram illustrating a first step of a driving method for luminous elements according to a first embodiment of the present invention.

The present invention will be described below with reference to preferred embodiments.

(First Embodiment)

FIG. 1 through FIG. 6 show a first embodiment. This first embodiment corresponds to a case in which one of n cathode lines is connected to a source voltage and remaining (n-1) cathode lines are connected to the ground potential when switching a scanning line to the next cathode line.

In FIG. 1 through FIG. 5, reference numerals A1 through A256 are anode lines, B1 through B64 are cathode lines, and E1.1 through E64.256 are luminous elements connected at each intersection position.

Scanning switches 21 through 264 for selecting either the source voltage (VCC) or the ground potential (0V) are connected to cathode lines B1 through B64 in order to carry out sequential scanning. Drive switches 31 to 3256 for selecting current sources 11 through 1256, that is, the drive source, or ground potential (0V) are connected to the anode lines A1 through A256.

The operation for emitting light is described next with reference to FIG. 1 through FIG. 5. The operation described below will be explained by referring to an example in which luminous elements E1.1 and E1.2 are driven to emit light by scanning cathode line B1, then elements E2.1 and E2.3 are driven to emit light by shifting scanning to cathode line B2, and then elements E3.1 and E3.2 are driven to emit light by shifting scanning to cathode line B3. Further, in order to facilitate this description, the luminous elements emitting light are indicated by the diode symbol and the other luminous elements that are not emitting light are indicated by the capacitor symbol.

In FIG. 1 scanning switch 21 is at first switched to the 0V side and cathode line B1 is scanned. Source voltage VCC is applied by scanning switches 22 through 264 to the other cathode lines B2 through B64. Current sources 11 and 12 are further connected to anode lines A1 and A2 by drive switches 31 and 32, and 0V is applied by drive switches 33 through 3256 to the other anode lines A3 through A256.

In the case shown in FIG. 1, therefore, only luminous elements E1.1 and E1.2 are biased in the forward direction, drive current flows from current sources 11 and 12 as shown by the arrows, and only luminous elements E1.1 and E1.2 emit light. In the state shown in FIG. 1, the luminous elements shown by a hatched capacitor are charged, respectively, in the direction of the polarity shown in the figure. The following reset control shown in FIG. 2 is then carried out when shifting scanning from the emission state shown in FIG. 1 to the state in which luminous elements E2.1 and E2.3 emit light as shown in FIG. 3.

Figure 2:
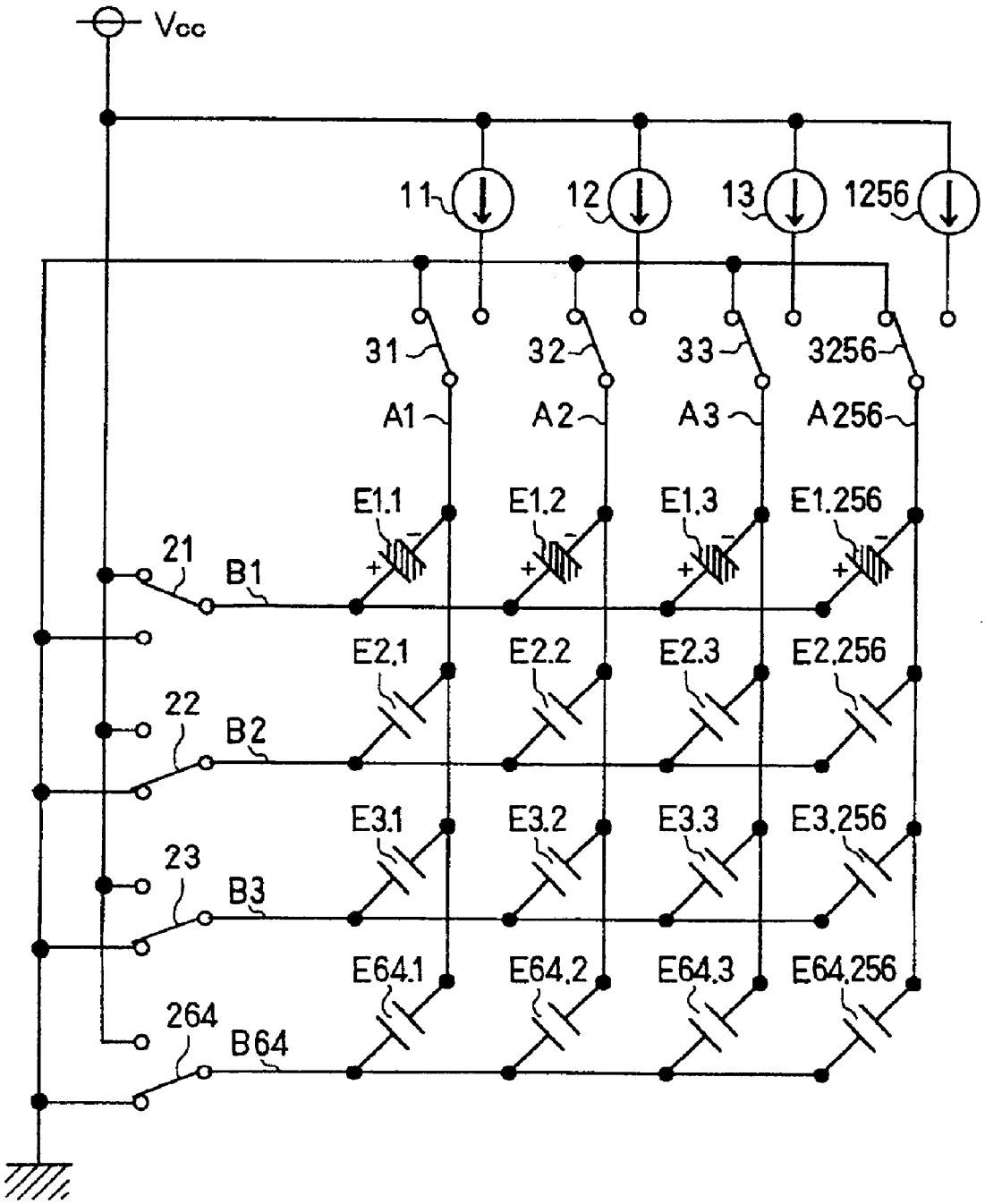
FIG. 2 is an equivalent circuit diagram illustrating a second step of the driving method of the first embodiment.
Figure 3:
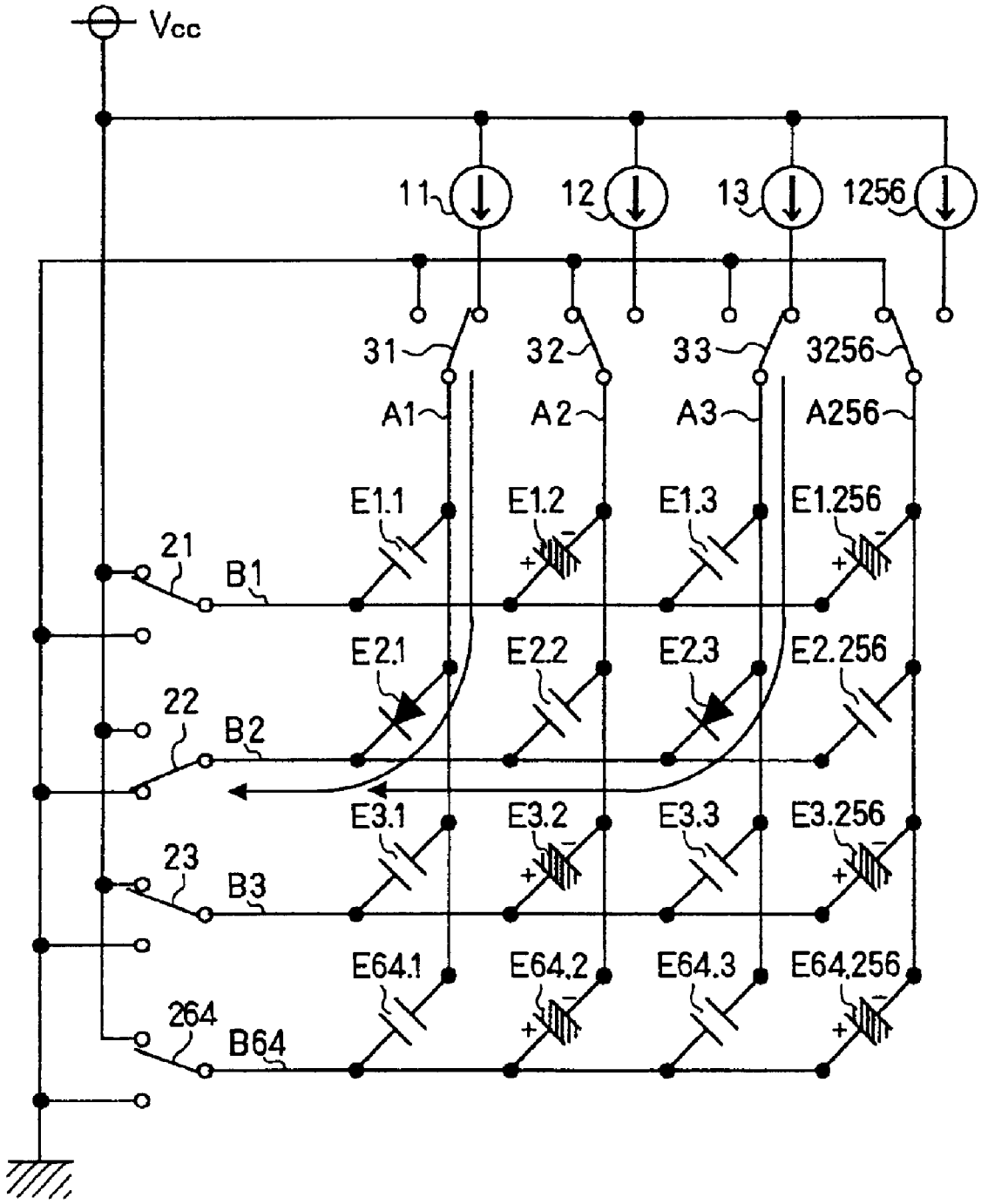
FIG. 3 is an equivalent circuit diagram illustrating a third step of the driving method of the first embodiment.

That is, before shifting the scan from the cathode line B1 in FIG. 1 to the cathode line B2 in FIG. 3, all of the driving switches 31 through 3256 and all of the scanning switches 22 through 264 except scanning switch 21 are switched to 0V, and scanning switch 21 is switched to the source voltage as shown in FIG. 2. This results in the luminous elements on scanning line B1 being charged by the reverse bias and the charge in the luminous elements on cathode lines B2 through B64 becoming zero.

When the scanning line is switched by the prior art driving method, the charge stored in all luminous elements becomes zero and the reverse bias is not applied to the luminous elements because all cathode lines and anode lines are reset to 0V. In this first embodiment, however, the reverse bias is always applied to the luminous elements on cathode line B1. Furthermore, when the scanning line shifts as shown in FIG. 2, the luminous elements on cathode line B2 driven to emit light build up to light emission at substantially the same time because the luminous elements on all anode lines are charged to the same state. As a result, luminance is not uneven.

As described above, after applying the reverse bias potential to the luminous elements on cathode line B1, scanning switches 23 through 264 corresponding to cathode lines B3 through B64 switch to the source voltage VCC side and cathode line B2 is scanned as shown in FIG. 3. Drive switches 31 and 33 switch to current sources 11 and 13 at the same time, driving luminous elements E2.1 and E2.3 to emit light. In the state shown in FIG. 3, the luminous elements shown with hatched capacitor are, respectively, charged in the direction of the polarity as shown in the figure. The following reset control shown in FIG. 4 is then carried out when shifting scanning from the emission state shown in FIG. 3 to the state in which luminous elements E3.1 and E3.2 emit light as shown in FIG. 5.

Figure 4:
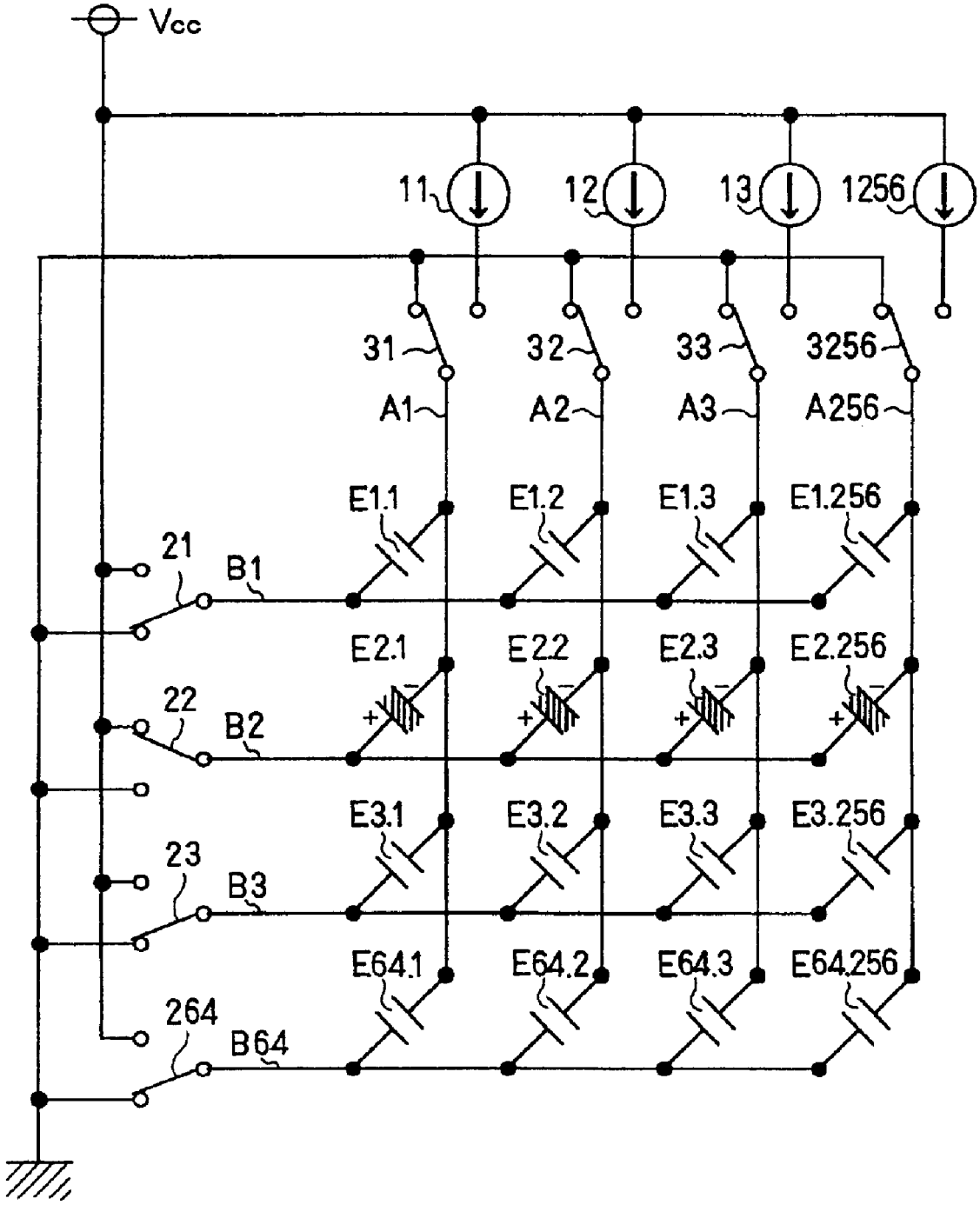
FIG. 4 is an equivalent circuit diagram illustrating a fourth step of the driving method of the first embodiment.
Figure 5:
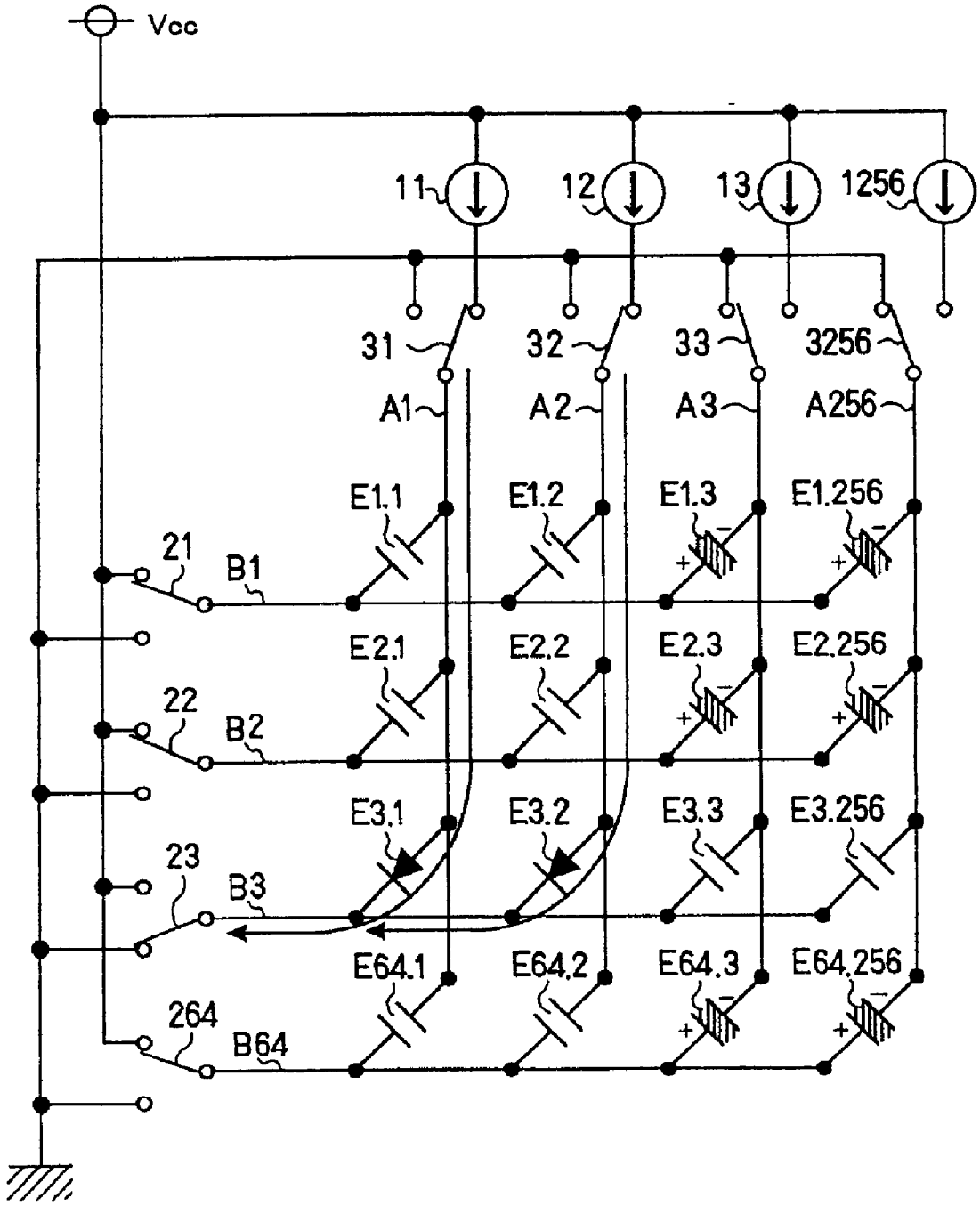
FIG. 5 is an equivalent circuit diagram illustrating a fifth step of the driving method of the first embodiment.

That is, before shifting the scan from the cathode line B2 in FIG. 3 to the cathode line B3 in FIG. 5, all of the driving switches 31 through 3256 and all of the scanning switches 21 and 23 through 264 except scanning switch 22 are switched to 0V, and scanning switch 22 is switched to the source voltage as shown in FIG. 4. This results, as also shown in FIG. 4, in the luminous elements on scanning line B2 being charged by the reverse bias and the charge in the luminous elements on cathode lines B1 and B3 through B64 becoming zero.

In this case, as shown in FIG. 4, the reverse bias is always applied to the luminous elements on cathode line B2. Furthermore, the luminous elements on cathode line B3 driven to emit light build up to emission at substantially the same time because the luminous elements on all anode lines are charged to the same state. As a result, luminance is not uneven.

As described above, after applying the reverse bias potential to the luminous elements on cathode line B2, scanning switches 21, 22 and 24 through 264 corresponding to cathode lines B1, B2 and B4 through B64 switch to the source voltage VCC side and cathode line B3 is scanned as shown in FIG. 5. Drive switches 31 and 32 switch to current sources 11 and 12 at the same time, thus driving luminous elements E3.1 and E3.2 to emit light.

The above operation continues until cathode line B64 is scanned.

The above driving method thus applies the reverse bias voltage to luminous elements on cathode line B1 when switching from cathode line B1 to B2, and applies the reverse bias voltage to luminous elements on cathode line B2 when switching from cathode line B2 to B3. Because this same operation repeats until cathode line B64 is scanned, the reverse bias voltage is always applied at least once to the luminous elements on all cathode lines. Furthermore, when luminous elements on the next cathode line are driven to emit light, build-up to emission is substantially simultaneous because the luminous elements on all anode lines are all charged to the same state when shifting scanning. Luminance is therefore not uneven.

Figure 6:
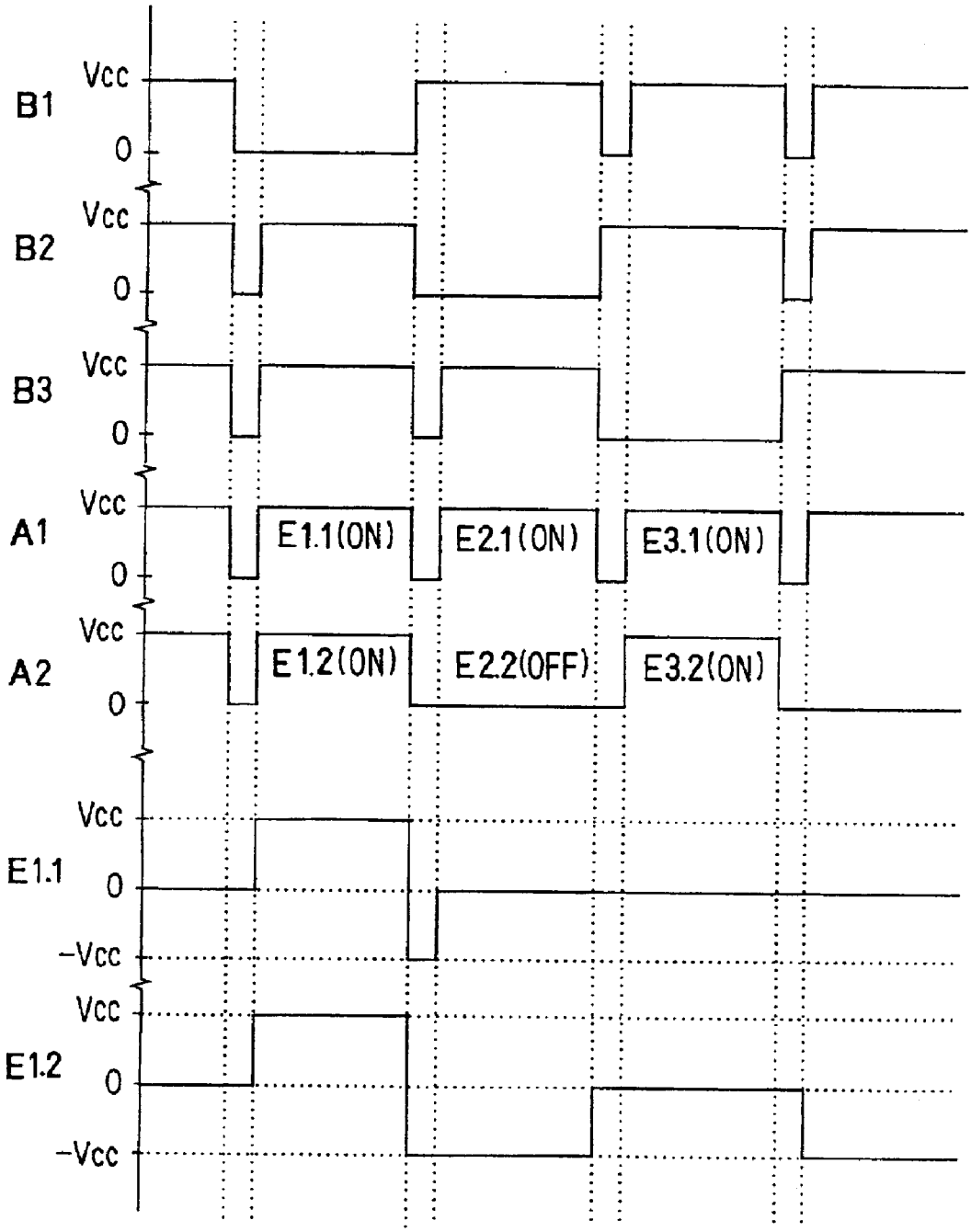
FIG. 6 is a timing chart illustrating operation of the driving method of the first embodiment.

FIG. 6 shows the voltage applied to the cathode line, each anode line, and the luminous elements.

Figure 16:
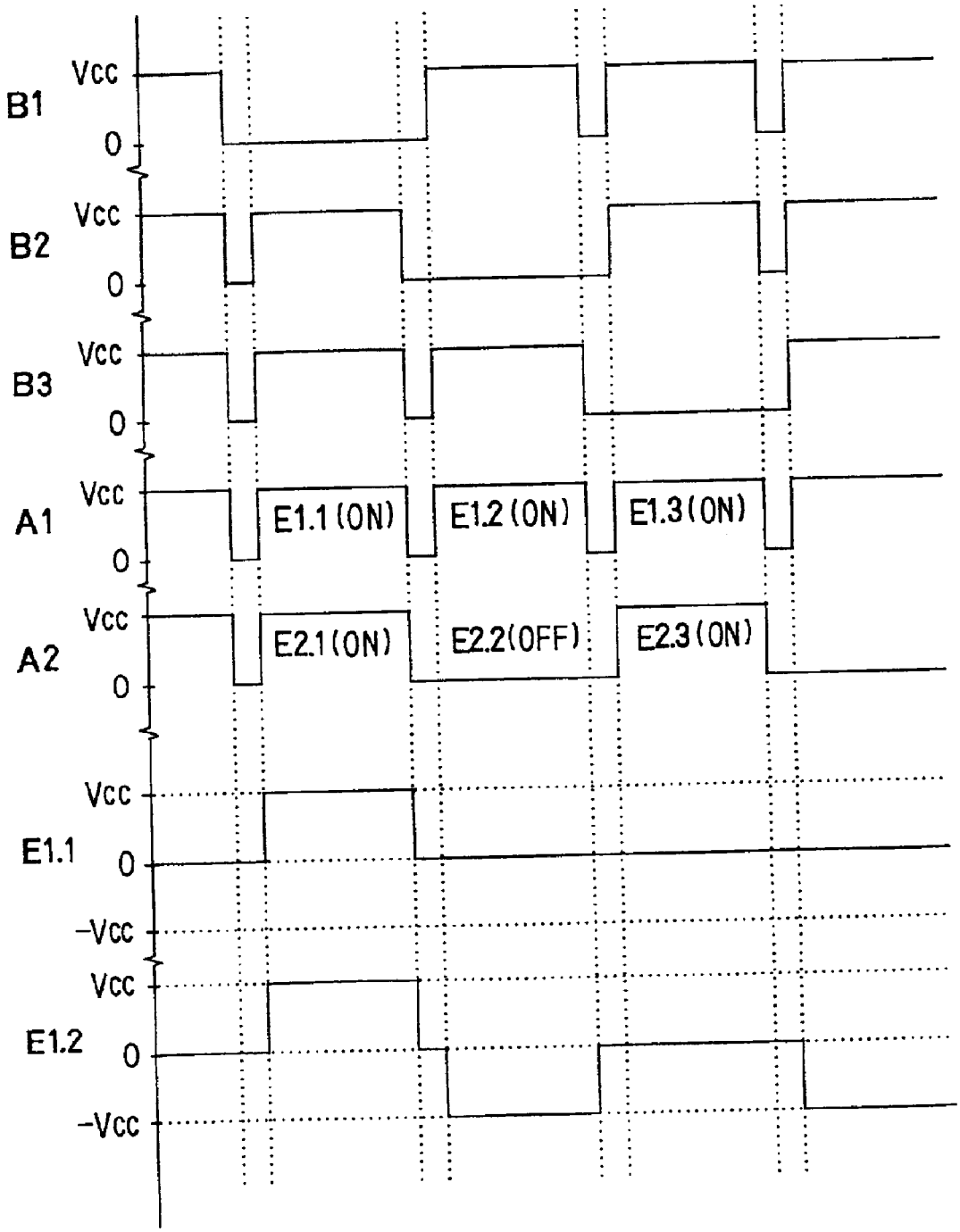
FIG. 16 PRIOR ART
FIG. 16 is a timing chart illustrating operation of the another prior art driving method.

In the state shown in FIG. 6 all luminous elements E1.1, E2.1, E3.1 . . . E64.1 on anode line A1 are emitting, and luminous elements E1.2, E2.2, E3.2 . . . E64.2 on anode line A2 are repeatedly emitting and not emitting. The difference of the voltage of anode line A1 and the voltage of cathode line B1 is applied to luminous element E1.1, and the difference of the voltage of anode line A2 and the voltage of cathode line B1 is applied to luminous element E1.2. While there is no period in which the reverse bias is applied to luminous element E1.1 in the prior art driving method as shown in FIG. 16, it will be understood that the reverse bias voltage is applied in the first embodiment when switching from cathode line B1 to B2.

It will be understood that the driving method of the first embodiment connects at least one cathode line to the source voltage and applies 0V to the other cathode lines before switching from a selected scanning line to the next scanning line. As a result, uneven luminance resulting from charge state differences does not occur, and applies the reverse bias when switching the scanning line to improve luminous element service life.

It will also be understood that while this embodiment is described using an example in which only one cathode line is connected to the source voltage and 0V is applied to the remaining cathode lines when shifting the scanning line, the same effect can be achieved if two, three or more cathode lines are connected to the source voltage.

(Second Embodiment)

Figure 7:
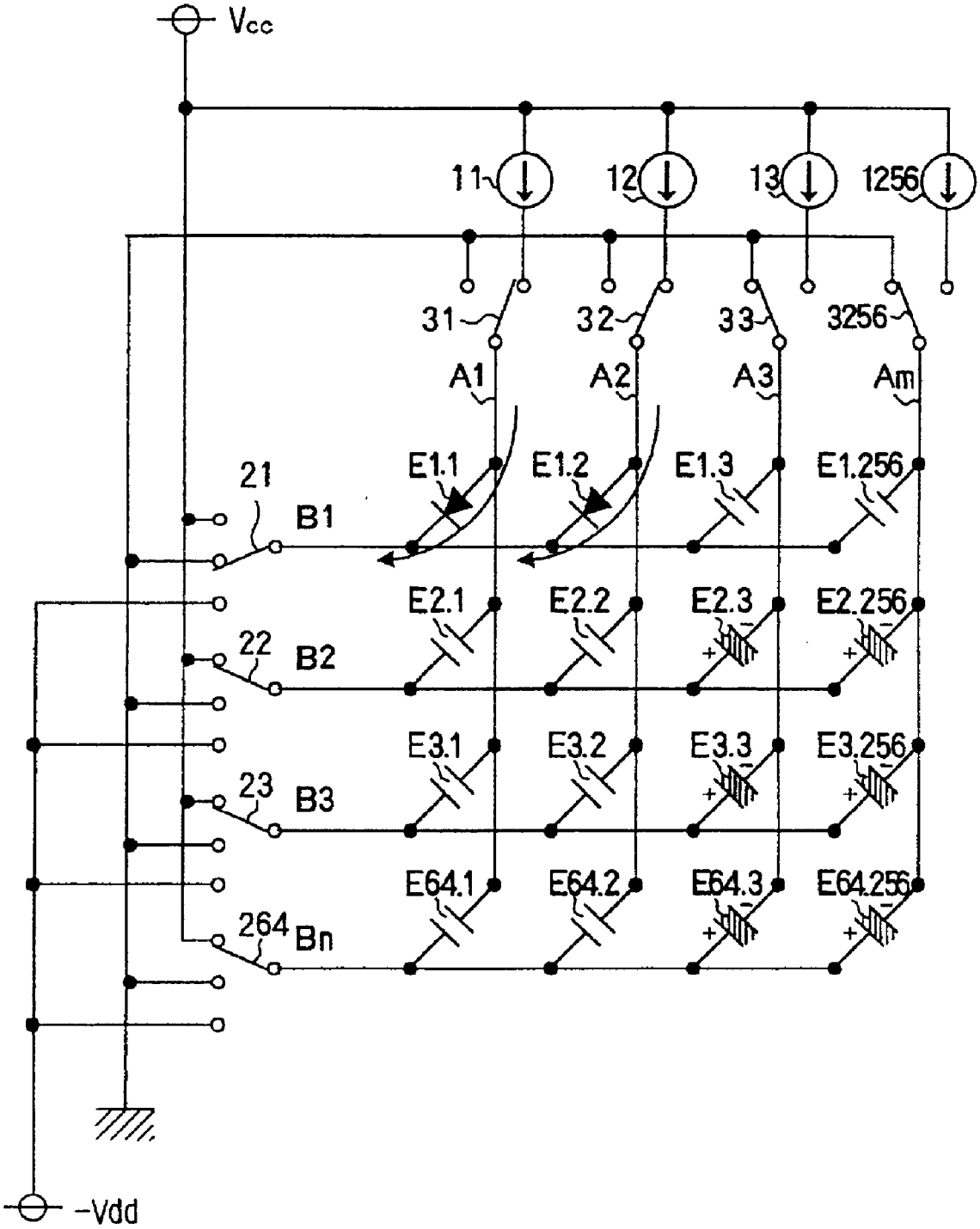
FIG. 7 is an equivalent circuit diagram illustrating a first step of a driving method for luminous elements according to a second embodiment of the present invention.
Figure 8:
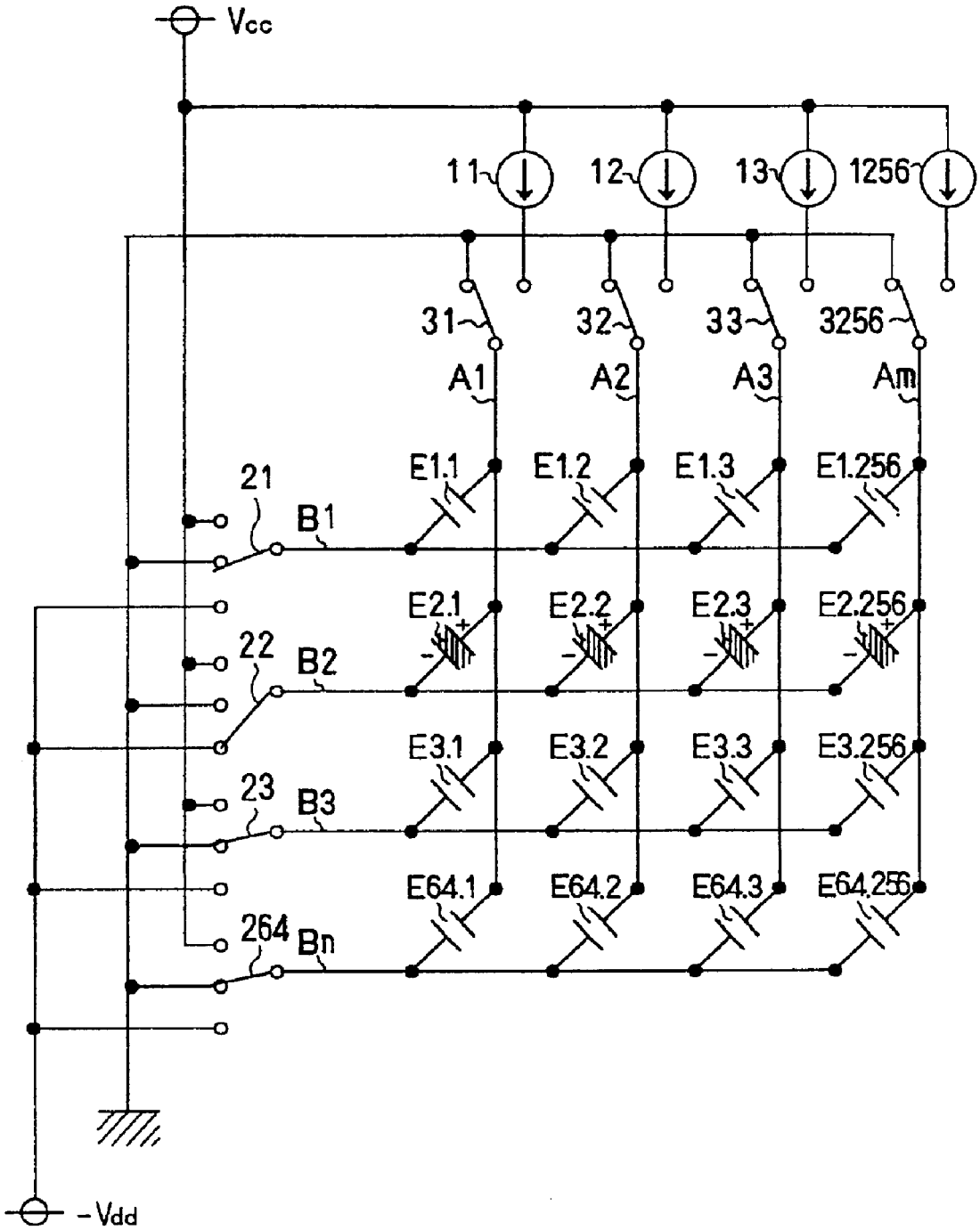
FIG. 8 is an equivalent circuit diagram illustrating a second step of the driving method according to the second embodiment.
Figure 9:
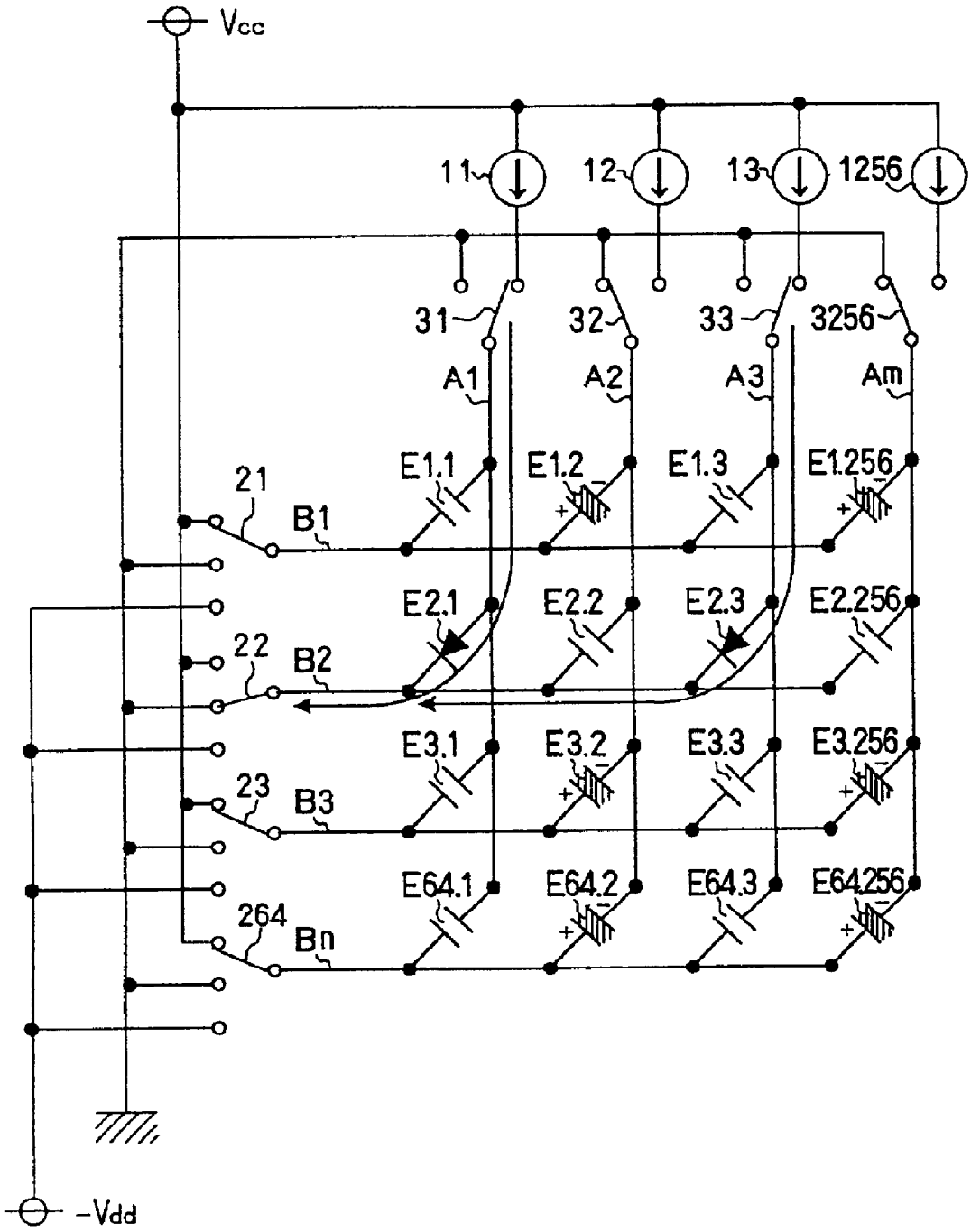
FIG. 9 is an equivalent circuit diagram illustrating a third step of the driving method according to the second embodiment.
Figure 10:
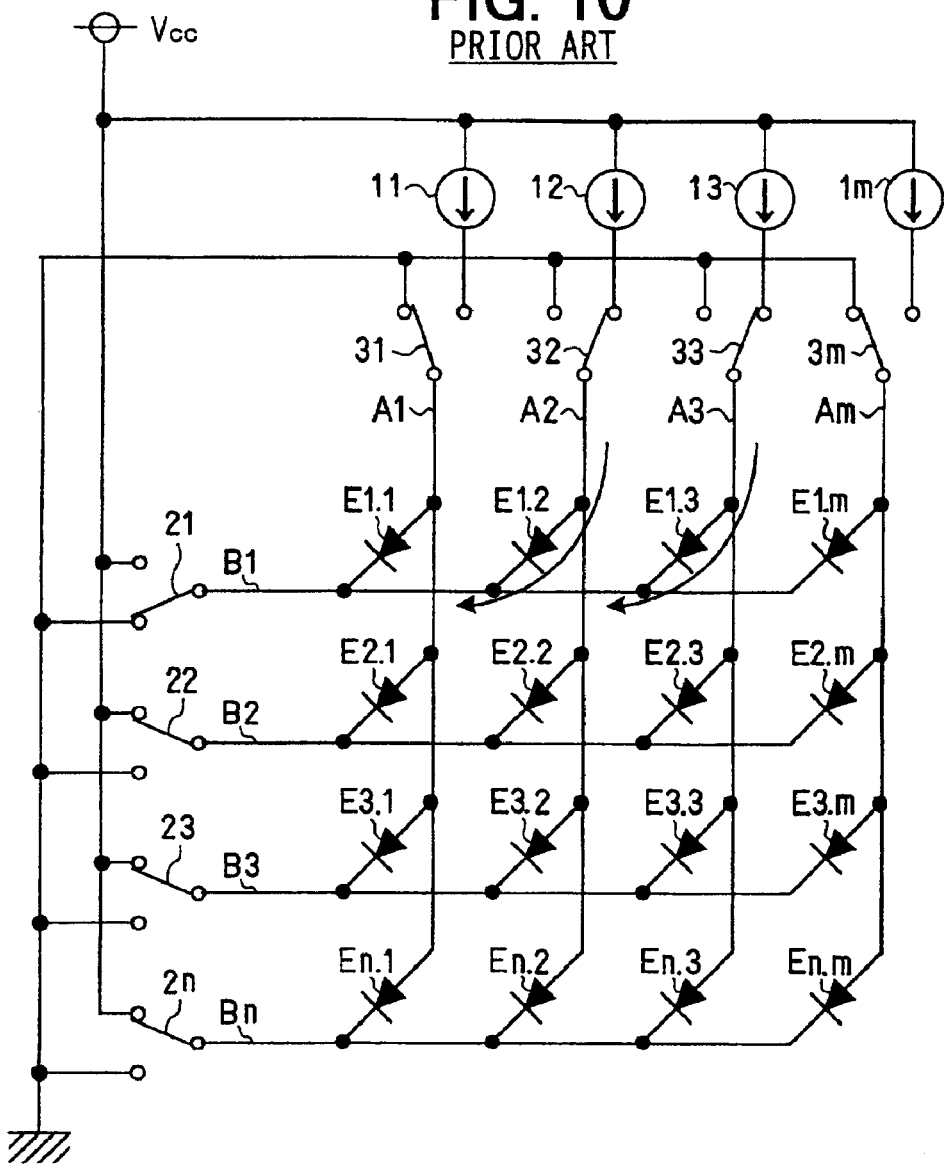
FIG. 10 PRIOR ART
FIG. 10 is an equivalent circuit diagram illustrating a prior art driving method.
Figure 11:
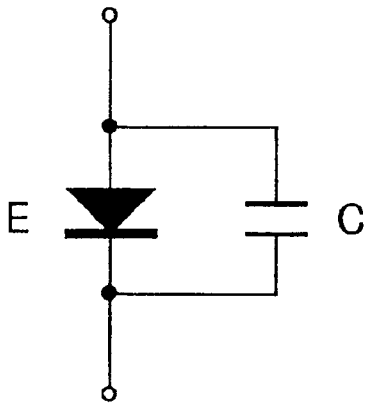
FIG. 11 PRIOR ART
FIG. 11 is an equivalent circuit diagram illustrating the prior art driving method.
Figure 12A:
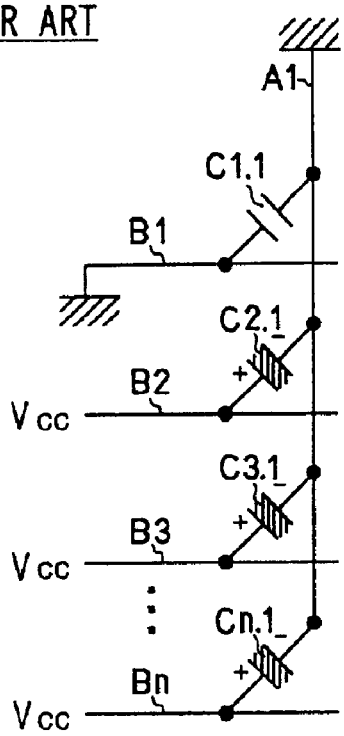
FIG. 12A PRIOR ART
FIGS. 12A to 12D are equivalent circuit diagrams illustrating the prior art driving method.
Figure 12B:
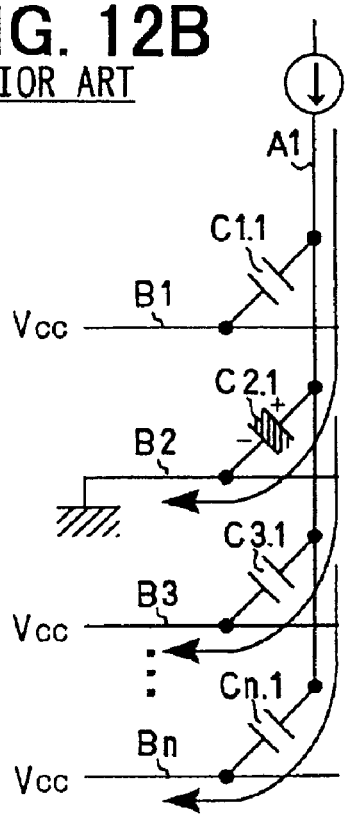
FIG. 12B PRIOR ART
Figure 12C:
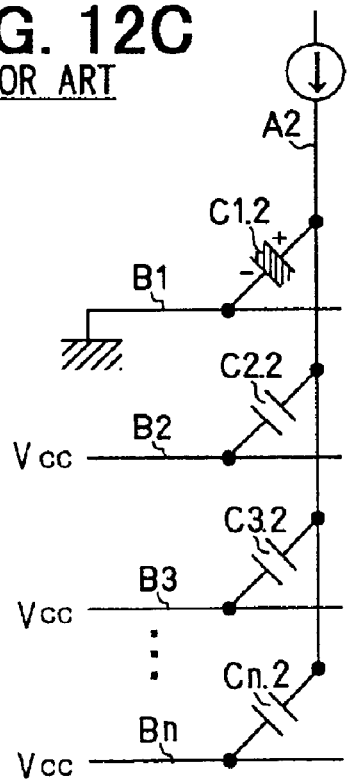
FIG. 12C PRIOR ART
Figure 12D:
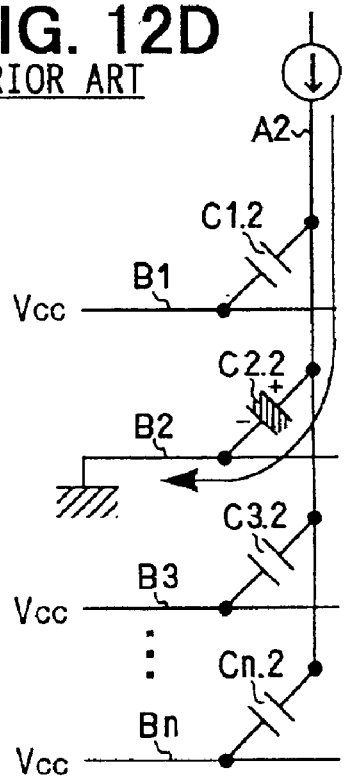
FIG. 12D PRIOR ART
Figure 13:
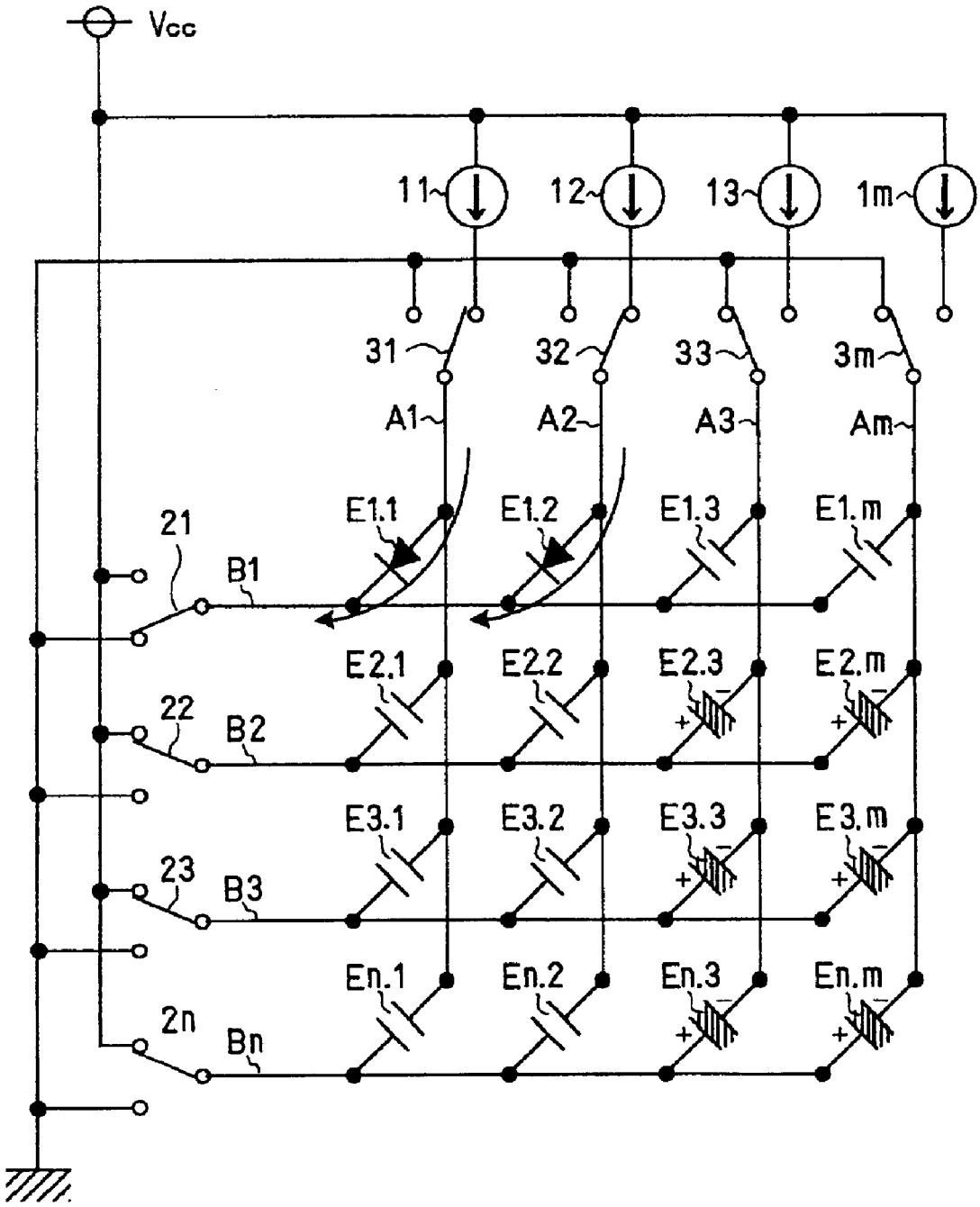
FIG. 13 PRIOR ART
FIG. 13 is an equivalent circuit diagram illustrating a first step of another prior art driving method.
Figure 14:
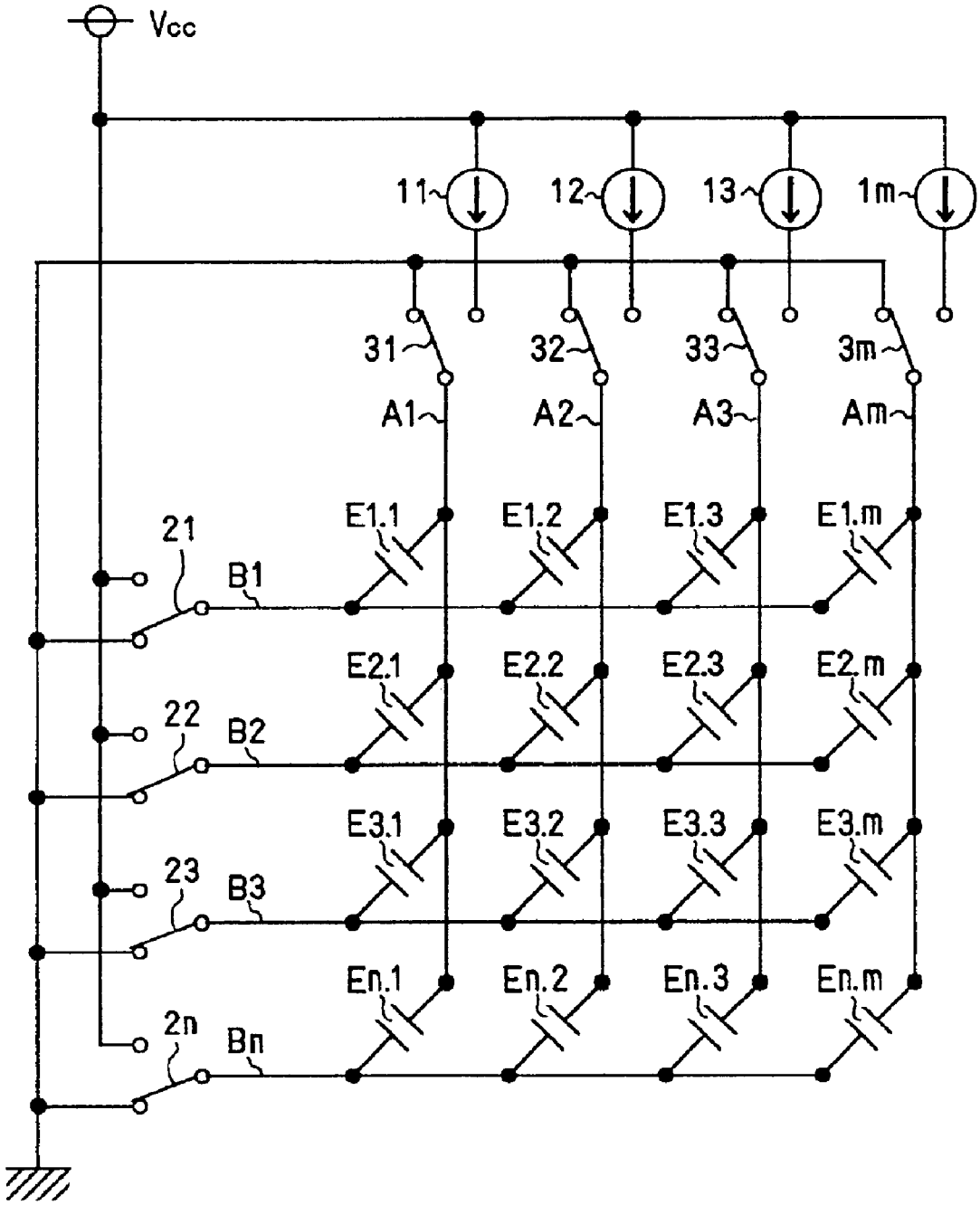
FIG. 14 PRIOR ART
FIG. 14 is an equivalent circuit diagram illustrating a second step of the another prior art driving method.
Figure 15:
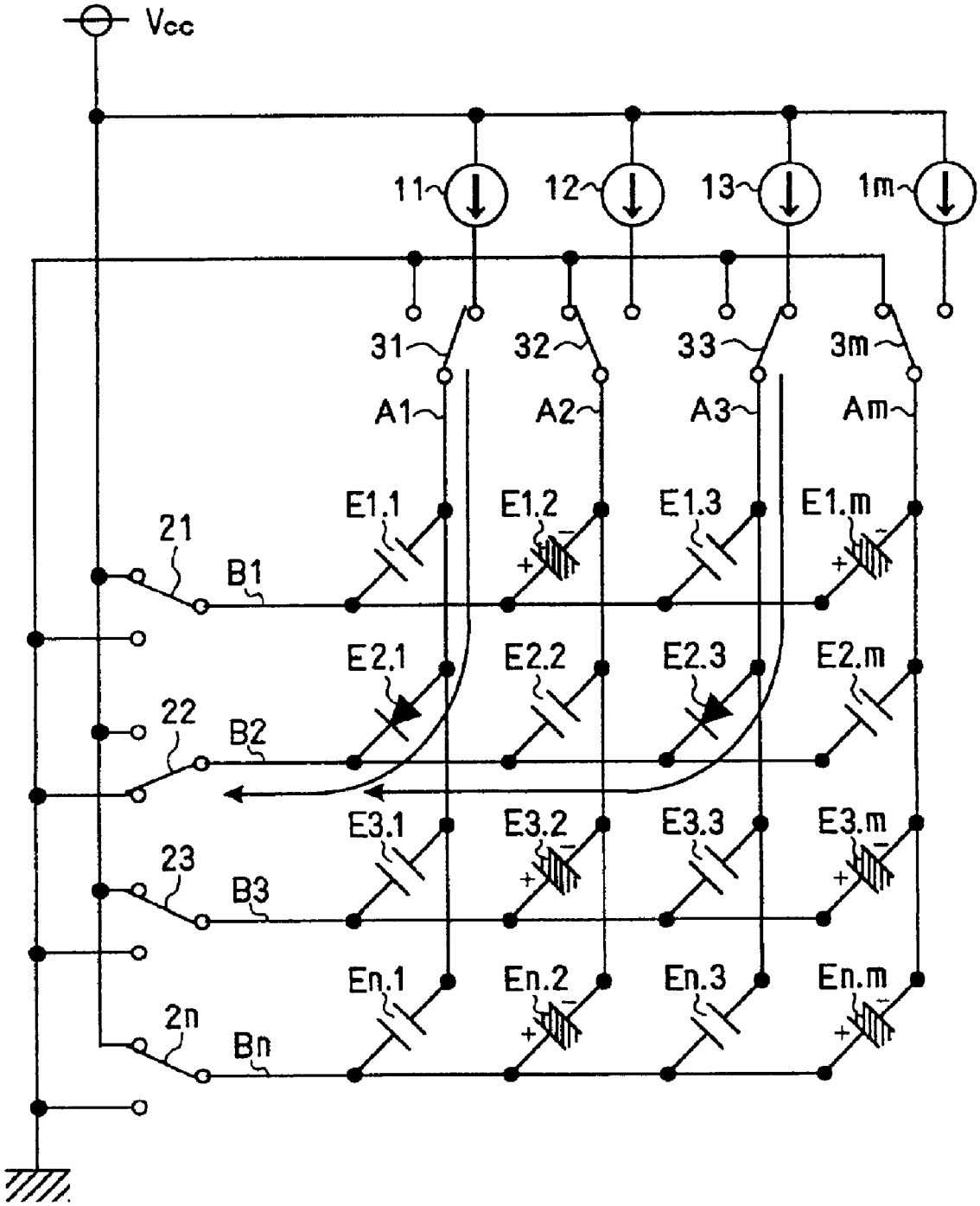
FIG. 15 PRIOR ART
FIG. 15 is an equivalent circuit diagram illustrating a third step of the another prior art driving method.

FIG. 7 through FIG. 9 show a second embodiment. This driving method corresponds to a case in which one of n cathode lines is connected to a negative potential (−Vdd) different from the source voltage and the remaining (n-1) cathode lines are connected to the ground potential when switching the scanning line to the next cathode line.

To apply negative potential −Vdd, scanning switches 21 through 264 can be switched to source voltage VCC, the ground potential, or negative potential −Vdd where voltage Vdd is below the emission threshold voltage of the luminous elements.

In FIG. 7, scanning switch 21 is at first switched to the 0V side and cathode line B1 is scanned. Source voltage VCC is applied by scanning switches 22 through 264 to the other cathode lines B2 through B64. Current sources 11 and 12 are further connected to anode lines A1 and A2 by drive switches 31 and 32, and 0V is applied by drive switches 33 through 3256 to the other anode lines A3 through A256.

In the case shown in FIG. 7, therefore, only luminous elements E1.1 and E1.2 are biased in the forward direction, drive current flows from current sources 11 and 12 as shown by the arrows, and only luminous elements E1.1 and E1.2 emit light.

Before shifting the scan from the cathode line B1 in FIG. 7 to the cathode line B2 in FIG. 9, all of the driving switches 31 through 3256 and all of the scanning switches 21 through 264 except scanning switch 22 are switched to 0V, and scanning switch 22 is switched to the potential −Vdd as shown in FIG. 8. This results in the luminous element charge states as shown in FIG. 8. That is, while the luminous elements on cathode line B2 are charged by forward bias Vdd, the stored charge of the luminous elements on cathode lines B1 and B3 through B64 becomes zero. It should be noted, however, that luminous elements E2.1, E2.2 . . . E2.256 do not emit light because Vdd is below the emission threshold value of the luminous elements.

Thus, after applying the forward bias potential to the luminous elements on cathode line B2, scanning switches 21 and 23 through 264 corresponding to cathode lines B1 and B3 through B64 switch to the source voltage VCC side, switch 22 corresponding to cathode line B2 switches to 0V, and cathode line B2 is scanned as shown in FIG. 9. Drive switches 31 and 32 switch to current sources 11 and 12 at the same time, causing luminous elements E3.1 and E3.2 to emit light.

The speed of build-up to emission is thus increased and fast scanning is possible because luminous elements E2.1, E2.2 . . . E2.256 on cathode line B2 are charged to forward bias Vdd at this time.

It will also be understood that, while this present embodiment is described using an example in which only one cathode line is connected to negative potential Vdd and 0V is applied to the remaining cathode lines when shifting the scanning line, the same effect can be achieved if two, three, or more cathode lines are connected to the source voltage.

It will also be noted that while these embodiments of this invention are described using luminous elements as an organic EL by way of example, the invention shall not be so limited. For instance, the present invention can be applied to a light-emitting diode or other current injection type luminous elements having a diode characteristic and a capacitor component.

What is claimed is:

1. A driving method for driving an electroluminescence device having a plurality of luminous elements provided at intersections of a plurality of anode lines and a plurality of cathode lines arranged in a matrix, the anode lines being a one of scan lines and drive lines and the cathode lines being an other of scan lines and drive lines, the driving method comprising:

driving one of the plurality of luminous elements provided at an intersection of a desired drive line to emit light in synchronism with scanning while scanning the scan lines at a specific frequency, wherein an already selected scanning line is switchedly connected to a source voltage to apply a reverse bias to the one of the plurality of luminous elements connected to the already selected scanning line, and at the same time remaining scanning lines other than the already selected scanning line are switchedy connected to a ground voltage so as to discharge a charge stored to others of the plurality of luminous elements connected to remaining scanning lines, in a course of switching from the already selected scanning line to a next scanning line.

2. The driving method as in claim 1, wherein:

the plurality of luminous elements include current injection type luminous elements.

3. The driving method as in claim 2, wherein:

the current injection type luminous elements include organic electroluminescent elements.

4. The driving method as in claim 1, wherein electric charges stored to the other luminous elements are discharged to zero by switchedly connecting the remaining scanning lines to the ground voltage.

5. A method for driving an electroluminescence device having a plurality of luminous elements, wherein the plurality of luminous elements are provided at intersections of a plurality of anode lines and a plurality of cathode lines arranged in a matrix, wherein each of the plurality of luminous elements are connected to a corresponding at least one of the plurality of anode lines and a corresponding at least one of the plurality of cathode lines, wherein each of the plurality of anode lines include a one of a scan line and a drive line and each of the plurality of cathode lines include an other of a scan line and a drive line, the driving method comprising:

driving one of the plurality of luminous elements located at an intersection of one of the plurality of anode lines and one of the plurality of cathode lines associated with a desired drive line to emit light while scanning a desired scan line corresponding to the intersection at a specific frequency, wherein the desired scan line is switchably connected to a source voltage to apply a reverse bias to the driven one of the plurality of luminous elements, and wherein scan lines associated with remaining ones of the plurality of luminous elements are switchably connected to a ground voltage so as to discharge a stored charge therein.

6. The method in accordance with claim 5, wherein the plurality of luminous elements include current injection type luminous elements.

7. The method in accordance with claim 6, wherein the current injection type luminous elements include organic electroluminescent elements.

8. The method in accordance with claim 5, further comprising:

driving, in accordance with a sequence, the remaining ones of the plurality of luminous elements located at remaining intersections of remaining ones of one of the plurality of anode lines and the plurality of cathode lines associated with remaining desired drive lines to emit light while scanning remaining desired scan lines corresponding to the remaining intersection at a specific frequency associated with the sequence, wherein, in accordance with the sequence, ones of the remaining desired scan lines are switchably connected to a source voltage to apply a reverse bias to the driven remaining ones of the plurality of luminous elements, and wherein, in accordance with the sequence, others of the remaining desired scan lines associated with remaining ones of the plurality of luminous elements are switchably connected to a ground voltage so as to discharge a stored charge therein.

9. A method for driving an electroluminescence device having a plurality of luminous elements connected to a corresponding plurality of anode lines and a corresponding plurality of cathode lines, wherein each of the plurality of anode lines include a one of a scan line and a drive line and each of the plurality of cathode lines include an other of a scan line and a drive line, the driving method comprising:

driving one of the plurality of luminous elements with a desired drive line to emit light while scanning a desired scan line at a specific frequency, wherein the desired scan line is switchably connected to a source voltage to apply a reverse bias to the driven one of the plurality of luminous elements, and wherein scan lines associated with remaining ones of the plurality of luminous elements are switchably connected to a ground voltage so as to discharge a stored charge therein.

10. The method in accordance with claim 9, wherein the plurality of luminous elements include current injection type luminous elements.

11. The method in accordance with claim 10, wherein the current injection type luminous elements include organic electroluminescent elements.

12. The method in accordance with claim 9, further comprising:

driving, in accordance with a sequence, the remaining ones of the plurality of luminous elements with remaining desired drive lines to emit light while scanning remaining desired scan lines at a specific frequency associated with the sequence, wherein, in accordance with the sequence, ones of the remaining desired scan lines are switchably connected to a source voltage to apply a reverse bias to the driven remaining ones of the plurality of luminous elements, and wherein, in accordance with the sequence, others of the remaining desired scan lines associated with remaining ones of the plurality of luminous elements are switchably connected to a ground voltage so as to discharge a stored charge therein.

* * * * *